United States Patent [19]

Michaux

[11] Patent Number: 4,615,200

[45] Date of Patent: Oct. 7, 1986

[54] FORMING PROCESS FOR METAL RAIL BLANK

[75] Inventor: Jacques M. Michaux, Joeuf, France

[73] Assignee: Sacilor, Hayange, France

[21] Appl. No.: 591,864

[22] Filed: Mar. 21, 1984

[30] Foreign Application Priority Data

Mar. 21, 1983 [FR] France ..... 83 04590

[51] Int. Cl.[4] ..... B21B 13/10

[52] U.S. Cl. ..... 72/225; 72/234

[58] Field of Search ..... 72/225, 234, 366, 226, 72/229

[56] References Cited

U.S. PATENT DOCUMENTS

| | | | |
|---|---|---|---|
| 410,107 | 8/1889 | Kennedy et al. | 72/225 |
| 1,667,875 | 5/1928 | Smith | 72/366 |
| 3,342,052 | 9/1967 | Stammbach | 72/226 |
| 3,597,954 | 8/1971 | Nakajima | 72/225 |
| 3,848,447 | 11/1974 | Strandell | 72/366 |
| 4,344,310 | 8/1982 | Kozono et al. | 72/234 |
| 4,400,962 | 8/1983 | Michaux | 72/225 |

FOREIGN PATENT DOCUMENTS

| | | | |
|---|---|---|---|
| 0023825 | 1/1980 | European Pat. Off. . | |
| 47-1096 | 1/1972 | Japan | 72/234 |
| 5564905A | 7/1978 | Japan . | |
| 2033278A | 10/1979 | United Kingdom . | |

*Primary Examiner*—Francis S. Husar
*Assistant Examiner*—Robert Showalter
*Attorney, Agent, or Firm*—Stiefel, Gross, Kurland & Pavane

[57] ABSTRACT

A process for forming a rail blank in a universal stand, starting with an initial section (1) of rectangular cross-section comprising a first series of passes for cutting into the web forming portion by way of horizontal rolls (2, 3) accompanied by reduction of the head by way of one of the vertical roll (5), and a second series of passes for simultaneously reducing the head flank forming portions by the horizontal rolls (2, 3) and the base forming portions by one of the vertical roll (4) of the universal stand, the other roll (5) remaining non-active.

11 Claims, 13 Drawing Figures

FORMING PROCESS FOR METAL RAIL BLANK

TECHNICAL FIELD

This invention relates to a forming process for a metal rail blank which is subsequently rolled by the universal rail rolling process.

DISCLOSURE OF THE INVENTION

The blanks, which have a roughly shaped cross section, were formed in the prior art by rolling in two-high stands. The invention described herein presents a novel forming process making maximum use of a group of universal and edging stands (universal stand and two-high stand) in a rolling mill, thereby eliminating the traditional breakdown(s).

The process of the invention comprises two main phases. In a first series of passes, a first phase of cutting into the portion which will form the web is implemented by means of the horizontal rolls of the universal stand, together with a reducing of the head made by means of one of the vertical rolls. In a second series of passes, a second phase of simultaneous reduction of the web and of the head flanks is accomplished by means of the horizontal rolls, with a reduction of the base by means of one of the vertical rolls of the universal stand, the other vertical roll remaining non-active.

The initial cutting in of the web forming portion means that this part is first reduced at the expense of the reduction of the base or head forming portions. This allows, through an initial rapid roughing, a reduction in the total number of passes required.

When the ratio of the width of the base to the thickness of the blank is relatively important, in accordance with one aspect of the invention, the base may be formed by successive slotting and rolling by means of different shaped rollers.

And accurate symmetrization of the blank are obtained in a open groove in the two-high stand normally associated with the universal stand. It is advantageous to arrange the two-high stand and the universal stand side by side, or on offset axes, rather than in line, in order not to be dependent on constraints of pass shapes or sequence of passes.

The two phases of the inventive process may be practiced through use of the same pair of horizontal rolls having staged barrels, the space between the two stages being equal to the depth of the cutting into the web during the first phase.

Further features and advantages of the present invention will be more fully apparent from the following description and annexed drawings of the presently preferred embodiments thereof.

BEST MODE OF CARRYING OUT THE INVENTION

Figure 1:
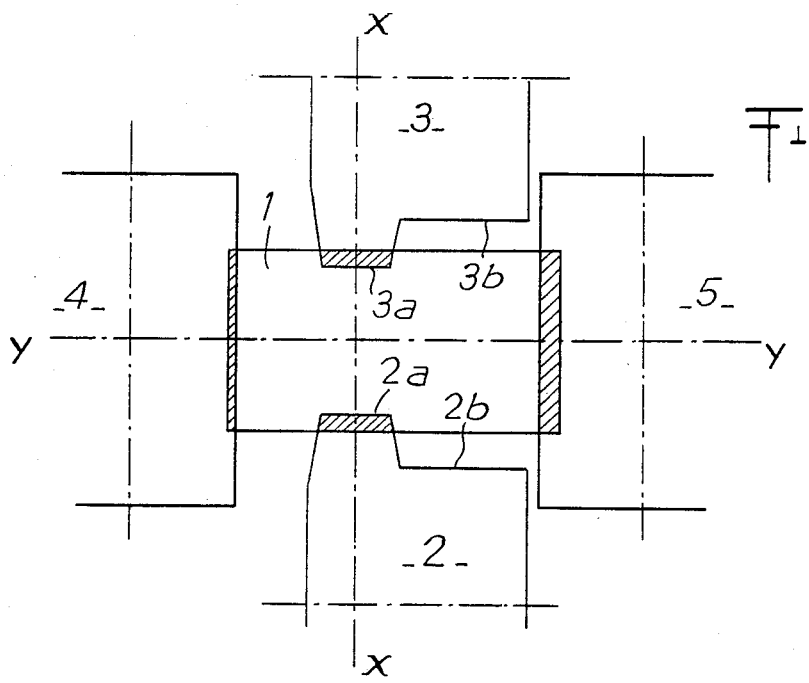
FIG. 1 shows the initial section within the universal stand of the invention.
Figure 2:
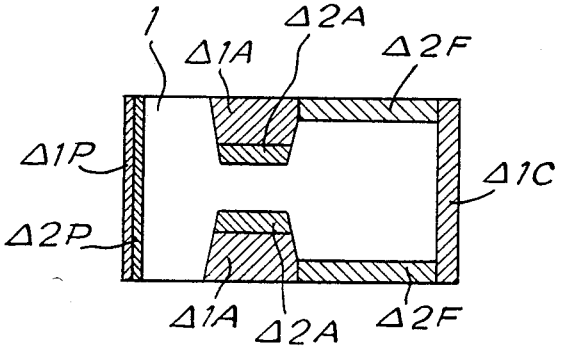
FIG. 2 illustrates a cross section of the initial section with right and left hatchings indicating, respectively, the reductions which take place in the first and second phases of the inventive process.

The initial section (1) passes into the universal stand of the invention, which comprises two horizontal rolls (2,3) having staged barrels, and two vertical rolls (4, 5).

Each horizontal roll (2, 3) has cylindrical parts 2*a* and 3*a* of enlarged diameter used for cutting into the part which will become the web in the first phase, and for its reduction during the second phase. The cylinder parts 2*b* and 3*b* of smaller diameter are used exclusively during the second phase for reduction of the head flanks.

Thus in the first phase, which may be referred to as the cutting into phase, the horizontal rolls 2*a* and 3*a* pull the product (1) while substantially reducing (reduction Δ1A) the part which will form the web; the vertical rolls (4, 5) basically center the product (1) in the vertical plane of rolling, axis XX, which generally differs from the vertical symmetry plane of the profile. Therefore, since the profile parts arranged on either side of the XX axis of cutting into are not the same, the average elongation rate is not established equally on both sides.

The metal flow tends to follow a direction moving away, more or less, from the rolling axis, depending upon the differences of the volume bulks located on either side of the cutting into axis. Without compensation, the direction of exit of the bar diverges from the rolling plane, i.e. one would say the bar "mows".

To restore coincidence of the exit direction with the rolling plane, it is necessary to effect a complementary elongation by an additional reduction of the initially heaviest section, generally on the head side, where the vertical roll (5) exerts a certain direct pressure intended to restore the balance, while the vertical roll (4) on the base side only exerts an indirect counter pressure due to the cutting into the web part.

However, taking into account the fact that the vertical roll (5) on the head side works only during the first phase of the process, until it touches the horizontal rolls (2, 3) it is necessary to exert, during said first phase, the entire reduction $\Delta_1C$ intended for the head. This reduction being in principle superior to the sole additional reduction designed to maintain the direction of exit of the product, one must also reduce the base by direct pressure with the vertical roll (4) (reduction $\Delta_1P$).

For practical purposes it is necessary to apply adequate reduction by selective action on the various parameters which control the conditions of balance of the rolling force system. The most significant parameters to be considered are the roll diameters, particularly those of the vertical rolls, the relationship between them being defined by the Δ of reduction, the pressure and reduction rate, and the flow coefficient.

The first step is complete when the cutting into $\Delta_1A$ of the web has been exerted over a depth corresponding to the difference in diameter between parts (3*a*, 3*b*) and (2*a*, 2*b*) of the horizontal rolls (2, 3).

In the course of the second phase, the horizontal rolls (2, 3) exert a reduction $\Delta_2A$ over the center-rib by means of parts 2*a* and 3*a*, and a reduction equal to $\Delta_2F$ on the head flanks by means of parts 2*b* and 3*b*; and the vertical roll (5) on the head side is not active while the vertical roll (4) on the base side exerts a reduction $\Delta_2P$.

In the case of rails having relatively large base width (with respect to the thickness of the initial section), in accordance with the invention the forming process may be accomplished by successive slotting and rolling of the base, using different vertical rolls which roll sequentially according to a particular sequence.

Figures 3A, 3B, 3C:
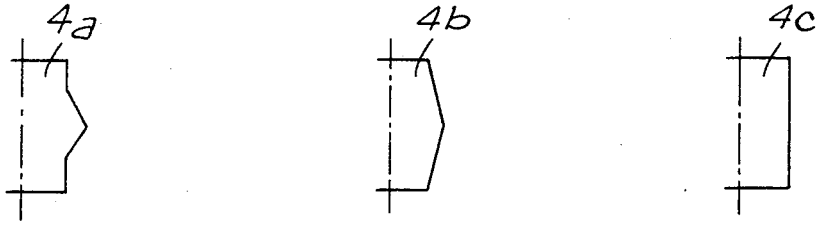
FIGS. 3A–3C illustrates three types of vertical rolls with open profiles adapted to slotting of the base in accordance with one aspect of the invention.
Figure 4A:
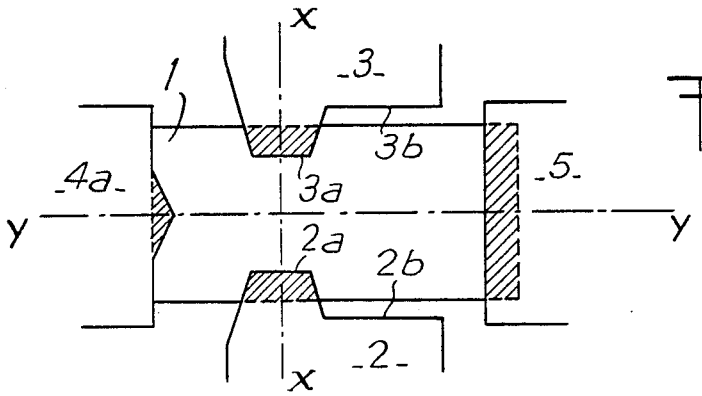
FIGS. 4A and 4B show the slotting and rolling of the base with the vertical roll of FIGS. 3A and 3C, respectively, as accomplished during the first (FIG. 4A) and second (FIG. 4B) phases of the invention.
Figure 4B:
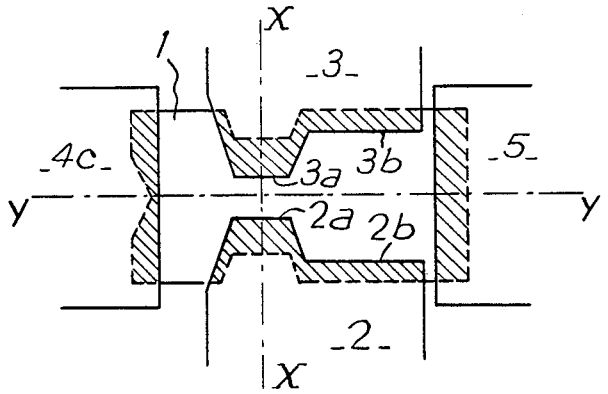

For example, the three vertical rolls 4*a*, 4*b*, 4*c* of open type, shown in half profile in FIGS. 3A, 3B, 3C can be used advantageously according to the sequence a, a, c, c, where the deep slotting practiced by the vertical roll 4*a* (FIG. 4A) during the cutting into the web is followed by rolling, by the vertical roll 4*c* (FIG. 4B), during the reduction of the web. These vertical rolls of different profiles may be located on several stands in succession, or on special chocks, such as shiftable chocks of known type or turret chocks as disclosed in French Patent application No. 82 13 781.

In the second phase of the process, it is necessary to balance the elongations on either side of the rolling vertical plane. It is required that the lateral push on the blank by action of the vertical roll (4) be transmitted by the horizontal rolls, and absorbed in a known manner (roll chocks for example) by the stand.

Figure 6:
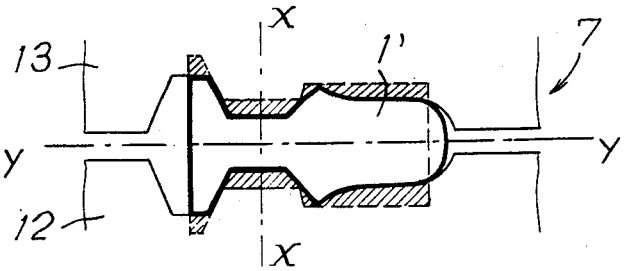
FIG. 6 shows the rolling of an exact blank in the two-high stand.

Rolling, executed by means of an alternating sequence with appropriate slotting, takes places in an edging stand, such as the two-high edging stand traditionally associated with the universal stand in a universal rolling mill. This two-high stand 7 (FIG. 6) is intended to roll the blank 1′ in the open groove of the horizontal rolls 12, 13 to insure sufficient working of the base extremities and a good symmetry of shape according to the horizontal plane YY, and in order to give the exact desired shape to the rail blank.

Figure 7:
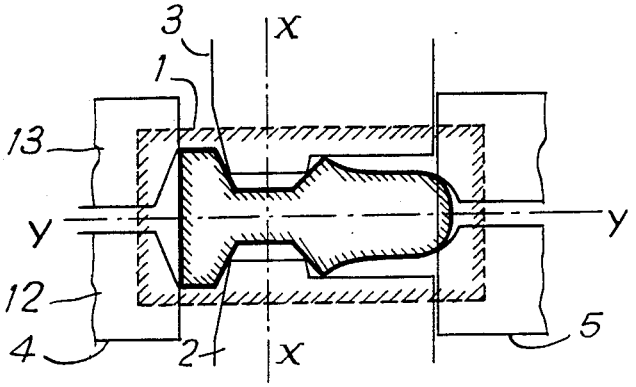
FIG. 7 shows the position of the exact blank in the initial section.

FIG. 7 shows the position of the blank 1′ in the initial section 1 and the relative location (in relation to initial section) of horizontal rolls 2, 3 and vertical rolls 4, 5 of the universal stand, and of the horizontal rolls 12, 13 of the two-high stand.

Figures 5A, 5B, 5C, 5D:
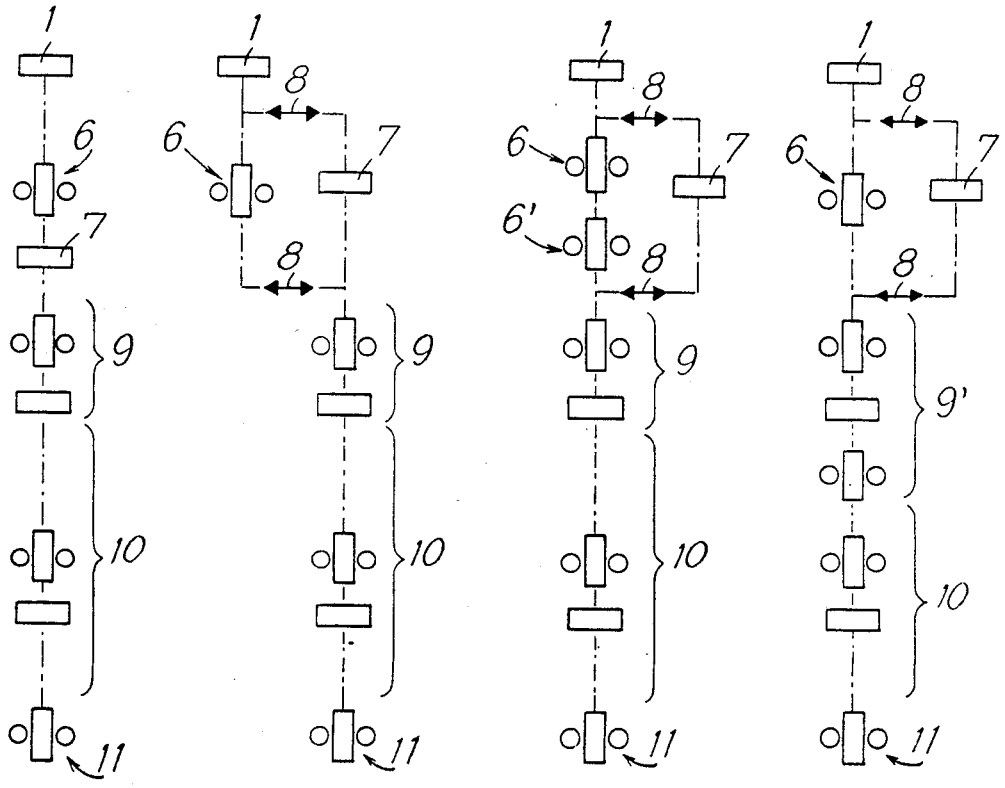
FIGS. 5A–5D illustrate four alternative arrangements of a fully universal rolling in accordance with the invention, from the initial section through the delivery of the finished rail.

One can, as shown in FIG. 5A, arrange the two-high stand and the universal stand in line. However, as illustrated in FIGS. 5B, 5C, and 5D, in the preferred embodiments the two-high stand and the universal stand are arranged side by side (FIGS. 5B, 5D) or on offset axes (FIG. 5C).

FIG. 5B shows symbolically the initial section 1, obtained for example by continuous casting, at the entrance or a roughing mill according to one aspect of the invention comprising a universal stand 6 and a two-high stand 7 located side by side. The arrows 8 symbolize alternative passages of the bar between stands 6 and 7 during the second phase of the process. After rolling on the stands 6, 7, rolling then continues in the traditional manner according to the universal process; (U.S. Pat. No. 3,342,053), in universal and edging stands, and including roughing (9) intermediary (10) and finishing (11) steps, until the finished section is obtained (U.S. Pat. No. 3,342,053).

FIG. 5D differs from FIG. 5B in the way it roughens the blank shaped according to the invention in a tandem 9′.

As previously discussed, according to the inventive process during a first series of passes, one favors the roughing of the part which is to become the web at the expense of the parts which will become the base and the head while the thicknesses are still important; this is to minimize the side strains while attempting to balance them, and to increase rapidly the possibilities of lateral reaction of the horizontal rolls in terms of the height of hold of their flanks which increases upon each pass.

The initial section must be perfectly centered in the rolling vertical plane. This is why it is advantageous, at the beginning of the first step, to employ a system of roller guides, upstream and downstream of the plane of the vertical rolls, to guide the bar when it is already engaged between parts 2*a*, 3*a* of the horizontal rolls, but not yet guided by the vertical rolls 4 and 5 of the stand.

I claim:

1. A process for transforming a rectangular bar into a rail blank on a universal stand having two horizontal rolls and two vertical rolls, the initial steps of said process consisting of: a first step (a) comprising a first series of passes for cutting into the web forming portion by means of the horizontal rolls accompanied by a reduction of the head by means of a first vertical roll to prevent uneven deformation; and a second step (b) comprising a second series of passes for simultaneously reducing the head flank forming portions by the horizontal rolls and the base forming portions by the other vertical roll of the universal stand, the first vertical roll performing no reduction of the head during said second step (b), but being used merely to engage the head for guiding the blank.

2. The process according to claim 1, wherein step (b) further comprises rolling said bar in open grooves of a two-high stand in alternating sequence with the passes in said universal stand.

3. The process according to claim 2, wherein the universal stand and the two-high stand are in side by side relation.

4. The process according to claim 2, wherein the respective axes of the universal stand and the two-high stand are offset.

5. The process according to claim 3, wherein the respective axes of the universal stand and the two-high stand are offset.

6. The process according to claim 1, wherein step (b) further comprises forming said base by successive slotting and rolling with vertical rolls of different profiles.

7. The process according to claim 5, wherein step (b) further comprises forming said base by successive slotting and rolling with vertical rolls of different profiles.

8. The process according to claim 1, wherein said step (a), further comprises laterally guiding the bar.

9. The process according to claim 7, wherein said step (a) further comprises laterally guiding the bar.

10. The process according to claim 1, wherein the horizontal rolls have staged barrels comprising first roll parts and second roll parts of lesser diameter than said first roll parts, and wherein the web is cut in during said step (a) and reduced during said step (b) by said first roll parts, and wherein the head flanks are reduced during said step (b) by said second roll parts.

11. The process according to claim 9, wherein the horizontal rolls have staged barrels comprising first roll parts and second roll parts of lesser diameter than said first roll parts, and wherein the web is cut in during said step (a) and reduced during said step (b) by said first roll parts and wherein the head flanks are reduced during said step (b) by said second roll parts.

* * * * *

UNITED STATES PATENT AND TRADEMARK OFFICE

CERTIFICATE OF CORRECTION

PATENT NO. : 4,615,200

DATED : October 7, 1986

INVENTOR(S) : Jacques M. Michaux

It is certified that error appears in the above-identified patent and that said Letters Patent is hereby corrected as shown below:

Column 3, line 2 change "center-rib" to --web--.

Signed and Sealed this

Twentieth Day of September, 1988

*Attest:*

DONALD J. QUIGG

*Attesting Officer*

*Commissioner of Patents and Trademarks*